US008822027B2

(12) United States Patent
Yamamoto

(10) Patent No.: US 8,822,027 B2
(45) Date of Patent: Sep. 2, 2014

(54) MOLD FOR PLASTIC FORMING AND A METHOD FOR PRODUCING THE SAME, AND METHOD FOR FORGING ALUMINUM MATERIAL

(75) Inventor: Kenji Yamamoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 205 days.

(21) Appl. No.: 13/252,420

(22) Filed: Oct. 4, 2011

(65) Prior Publication Data

US 2012/0131980 A1 May 31, 2012

(30) Foreign Application Priority Data

Nov. 30, 2010 (JP) ..... 2010-267341

(51) Int. Cl.

| | |
|---|---|
| ***B21J 13/02*** | (2006.01) |
| ***B21J 3/00*** | (2006.01) |
| ***B21K 5/20*** | (2006.01) |

(52) U.S. Cl.

CPC .. *B21J 3/00* (2013.01); *B21J 13/02* (2013.01); *B21K 5/20* (2013.01)

USPC ..... 428/336; 204/192.1; 204/192.15; 204/192.16; 249/114.1; 249/135; 264/239; 428/469; 428/472; 428/697; 428/698; 428/699

(58) Field of Classification Search

USPC ..... 428/336, 469, 472, 697, 698, 699; 249/114.1, 135; 204/192.1, 192.15, 204/19.16; 264/239

See application file for complete search history.

(56) References Cited

U.S. PATENT DOCUMENTS

| | | | | |
|---|---|---|---|---|
| 5,092,558 | A * | 3/1992 | Katsura | 249/135 |
| 5,324,594 | A | 6/1994 | Yasuda et al. | |
| 5,690,759 | A * | 11/1997 | Wang | 249/114.1 |
| 6,110,571 | A * | 8/2000 | Yaginuma et al. | 428/698 |
| 7,348,074 | B2 * | 3/2008 | Derflinger | 428/699 |
| 7,587,919 | B1 * | 9/2009 | Young | 249/135 |
| 7,879,443 | B2 * | 2/2011 | Endrino | 428/472 |

FOREIGN PATENT DOCUMENTS

| | | | |
|---|---|---|---|
| CN | 101380659 | | 3/2009 |
| JP | 5-117831 | A | 5/1993 |
| JP | 09-082765 | * | 3/1997 |
| JP | 2000-246330 | * | 9/2000 |

(Continued)

OTHER PUBLICATIONS

Office Action issued Dec. 18, 2012 in Japanese Patent Application No. 2010-267341 with English language translation.

*Primary Examiner* — Archene Turner

(74) *Attorney, Agent, or Firm* — Oblon, Spivak, McClelland, Maier & Neustadt, L.L.P.

(57) ABSTRACT

A mold for plastic forming having excellent seizure resistance controlled by adjusting its surface properties. In addition, a process producing the mold, that includes: roughening a surface of a base material by a shot blast method to adjust its arithmetic averaged roughness Ra: higher than 1 μm but 2 μm or lower; polishing the surface of the base material to adjust its skewness Rsk to 0 or lower while retaining Ra: 0.3 μm or higher; and forming a hard film on the surface of the base material where the surface of the hard film has an arithmetic averaged roughness Ra: 0.3 μm or higher but 2 μm or lower and skewness Rsk: 0 or lower. Adjusting the surface of the mold to have a non-concave-biased configuration, limits the capacity for concaves to accumulate lubricant, such that the lubricant is sufficiently deposited on the surfaces of the convexes.

6 Claims, 1 Drawing Sheet

(56) References Cited

FOREIGN PATENT DOCUMENTS

| | | |
|---|---|---|
| JP | 2000-271699 A | 10/2000 |
| JP | 2002-307129 | 10/2002 |
| JP | 2003-314561 | 11/2003 |
| JP | 2006-17218 A | 1/2006 |
| JP | 2008-19718 A | 1/2008 |
| JP | 2009-61464 | 3/2009 |
| JP | 2009-61465 A | 3/2009 |
| JP | 2010-99735 | 5/2010 |

* cited by examiner (Rsk<0)

(Rsk>0)

MOLD FOR PLASTIC FORMING AND A METHOD FOR PRODUCING THE SAME, AND METHOD FOR FORGING ALUMINUM MATERIAL

FIELD OF THE INVENTION

The present invention relates to a mold for plastic forming of a metallic material, and especially to a mold for plastic forming for use in warm-forging or hot-forging of an aluminum material.

BACKGROUND OF THE INVENTION

In general, a mold for producing forged articles is required to have wear resistance for increasing durability and sliding characteristics with a reduced coefficient of friction for suppressing abrasion due to sliding with the surfaces of forged articles. Therefore, a hard film is formed on the surface thereof. In recent years, for weight reduction of forged articles, application of aluminum materials (containing an aluminum alloy material, the same applies hereinafter) is increased. Since aluminum materials are soft, in hot-forging and warm-forging, they undergo large deformation while being forged, and a newly formed surface is exposed to be in contact with the mold, whereby seizure is likely to occur on the surface of the forged article.

In warm and hot forging, in order to prevent seizure (to impart seizure resistance), a lubricant is deposited on the surface of the mold by spraying and other so that the mold and the forged article are not in direct contact with each other. To this end, a mold whose surface properties are defined to allow retention of the lubricant deposited on the surface thereof has been developed. In Japanese Patent Laid-Open Publication No. 2009-61464, a mold for warm and hot forging which is covered with a hard film comprising a nitride or a carbonitride such as Ti and Cr, and has an arithmetic averaged roughness of the surface Ra defined to be in the range from 0.1 to 0.6 μm is disclosed. Japanese Patent Laid-Open Publication No. 2010-99735 discloses a forging mold having a layer comprising a nitride of a metal mainly composed of Al which is further laminated over a coating a layer comprising boride ($TiB_2$) of Ti, and a surface with an arithmetic averaged roughness Ra defined to 0.05 μm or lower. Japanese Patent Laid-Open Publication No. 2002-307129 discloses a tool for warm and hot processing in which a metal layer such as Ti and Cu is further laminated over a coating layer comprising a nitride or a carbonitride such as Ti and Cr, and the ten point averaged roughness Rz of its surface is defined to be in the range from 4 to 15 μm.

However, definition of the height (depth) and height difference of the unevenness on the surface of the mold such as Ra and Rz only is insufficient for retaining the lubricant. In particular, in plastic processing of a soft metal such as an aluminum material, seizure may occur under a high pressure of the contacted surface during forging.

SUMMARY OF THE INVENTION

The present invention was made in light of such problems, and an object of the present invention is to provide a mold for plastic forming having excellent seizure resistance.

In order to achieve the object, the inventors of the present invention noted, among the indices of the properties of the surface of the mold, the asymmetry (skewness) of concaves and convexes, and found that such a configuration in which the proportion of the parts constituting convexes is higher than that of the concaves has excellent retention of the lubricant.

In order to achieve the object, the mold for plastic forming according to the present invention is characterized in that a hard film is formed on a base material comprising a metal, and the surface of this hard film has an arithmetic averaged roughness Ra of 0.3 μm or higher but 2 μm or lower, and a skewness Rsk of 0 or lower.

Such a mold for plastic forming has excellent retention of the lubricant on the surface thereof, and therefore seizure resistance can be obtained.

In the mold for plastic forming according to the present invention, it is preferable that the hard film has a thickness of 1 μm or higher but 12 μm or lower, and is preferably either a nitride, a carbonitride or a carbide containing Al and at least one of Ti and Cr.

According to the mold for plastic forming in which a hard film whose thickness is limited in such a manner is formed, the surface properties can be easily controlled. In addition, according to the mold for plastic forming in which the hard film is formed from such a material, heat resistance and oxidation resistance are excellent, and in particular durability is excellent since the hard film is formed on the surface.

The mold for plastic forming according to the present invention is preferably used for warm-forging or hot-forging of an aluminum material.

In addition, the method for producing the mold for plastic forming according to the present invention carries out a base material roughening step which roughens the surface of a base material comprising a metal using the shot blast method, a base material polishing step which grinds this surface, and a film formation step which forms a hard film on the surface of the ground base material, to produce a mold for plastic forming having an arithmetic averaged roughness Ra: 0.3 μm or higher but 2 μm or lower and a skewness Rsk of the surface of the hard film: 0 or lower. Moreover, in the roughening treatment step, the surface of the base material is adjusted to have an arithmetic averaged roughness Ra: higher than 1 μm but 2 μm or lower, while in the polishing step, it is adjusted to have Ra: 0.3 μm or higher but 2 μm or lower and a skewness Rsk: 0 or lower.

In such a manner, the surface is adjusted by performing roughening and polishing on the base material, and therefore a hard film having appropriate surface properties can be readily formed.

The method for forging an aluminum material according to the present invention is characterized by warm-forging or hot-forging of an aluminum material with a lubricant applied and used on its surface of the mold for plastic forming.

Effect of the Invention

According to the mold for plastic forming according to the present invention, since it has a hard film having excellent retention of the lubricant on its surface, seizure can be also prevented in warm and hot forging of an aluminum material for which seizure resistance is particularly required. According to the method for producing the mold for plastic forming according to the present invention, a mold for plastic forming which allows for appropriate adjustment of its surface properties, and has excellent seizure resistance can be obtained. According to the method for forging an aluminum material according to the present invention, a forged article free of seizure can be obtained.

BRIEF DESCRIPTION OF SEVERAL VIEWS OF THE DRAWING

FIGS. 1A and 1B are an enlarged partial view of a cross section which illustrates the state of deposition of the lubricant according to the properties of the surface of the mold for plastic forming, wherein FIG. 1A is a model having a skewness Rsk lower than 0, while FIG. 1B is a model having a skewness Rsk higher than 0.

DETAILED DESCRIPTION OF THE INVENTION

<Mold for Plastic Forming>

The mold for plastic forming according to the present invention will be described.

The mold for plastic forming according to the present invention is a mold for forming for use in plastic processing, e.g., forging of a metallic material, which is a base material comprising a metal with a hard film coated thereon. The base material and hard film can be both formed from a known material which is applied to generic molds. Examples of the base material include alloy tool steels such as hot work tool steel SKD61, cold work tool steel SKD11 and high speed tool steel SKH51 and cemented carbides, among others. Examples of the hard film include single-layer films comprising nitrides, carbonitrides and carbides of Al, Ti and other elements, such as DLC (diamond-like carbon) and multilayer films produced by laminating two or more kinds of these films. In the mold for plastic forming according to the present invention (hereinafter referred to as mold for the sake of convenience), the configuration of the surface (hereinafter referred to as the surface of the mold) on which a hard film is formed is defined as follows:

(Arithmetic Averaged Roughness Ra: 0.3 μm or Higher but 2 μm or Lower)

When the surface of the mold is rough, its coefficient of friction is increased, and it cannot obtain seizure resistance even if the lubricant is applied thereon. Therefore, its arithmetic averaged roughness Ra, which is an amplitude average parameter in the height and depth directions, is 2 μm or lower, and preferably 1 μm or lower. In contrast, when the surface is made excessively smooth and the height difference in unevenness is lowered, the capacity of concaves in which the lubricant is accumulated is too small so that the lubricant cannot be retained during forging. In the present invention, the skewness Rsk described later is set to 0 or lower to suppress the volume ratio of the concaves. Therefore, the arithmetic averaged roughness Ra is set to 0.3 μm or higher, and preferably 0.4 μm or higher.

(Skewness Rsk: 0 or Lower)

Figure 1A:
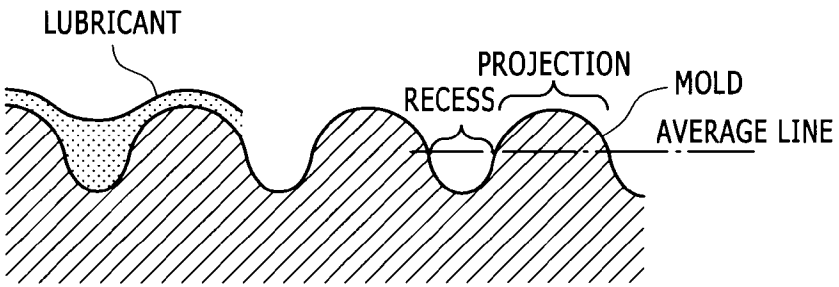
Figure 1B:
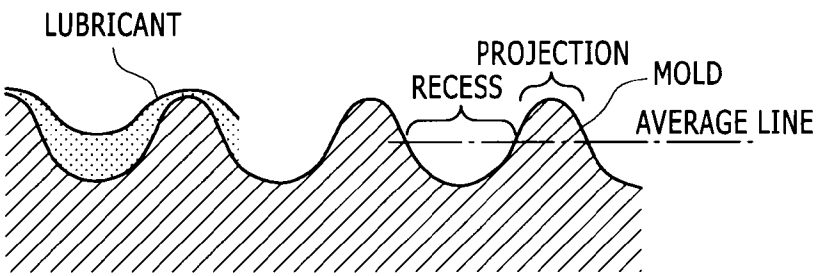

Skewness Rsk is the degree of the asymmetry (skewness) of convexes and concaves. When Rsk=0, convexes and concaves become symmetric in terms of volume with respect to the average line (shown by the chain line in FIGS. 1A and 1B) of the roughness curve of the cross section. In the enlarged partial view of the cross section of the mold shown in FIGS. 1A and 1B, to indicate the difference resulting from Rsk for the ease of understanding, the uneven configuration of the mold is indicated as uniform. When Rsk>0, as shown in FIG. 1B, an uneven configuration biased in the depth direction is provided. Therefore, the capacity of the concaves is increased, and much of the lubricant deposited on the surface of the mold accumulates in the concaves. The layer of the lubricant deposited on the surfaces of the convexes is made accordingly thinner. Therefore, in some portions where the heights in the unevenness protrude and regions where no lubricant is deposited may appear depending on the configuration of the mold. In the present invention, as shown in FIG. 1A, to suppress the volume ratio of the concaves and ensure retention of the lubricant deposited on the surfaces of the convexes, the skewness Rsk is set to be 0 or lower (FIG. 1A shows Rsk<0), and it is preferable that Rsk<−0.2. The lower limit of the skewness Rsk is not particularly defined, but when Rsk<−1, the capacity of the concaves is too small with respect to those of the convexes, and the lubricant is not sufficiently retained during forging. It is therefore preferable that the skewness Rsk is not higher than −1 and biased in the height direction.

The arithmetic averaged roughness Ra and skewness Rsk on the surface of the mold are parameters of surface properties defined in JIS B0601 (2001). The measurement methods of the parameters conform to the standard, and can be performed by known measurement devices. In addition, in order to adjust the surface to cause its values of both Ra and Rsk to be within the above-mentioned ranges, respectively, as will be described in connection with the production method later, it is preferable that the surface of the base material is adjusted; the surface is coated with a hard film; and further the surface of the hard film is adjusted, if necessary.

Furthermore, in the mold for plastic forming according to the present invention, it is preferable to constitute the hard film covering the surface as described below, which allows the mold to be suitably used for warm-forging or hot-forging and in particular for forging of aluminum materials.

The hard film of the mold for plastic forming according to the present invention preferably has a thickness of 1 μm or higher but 12 μm or lower. A thickness of the hard film of lower than 1 μm, although varying depending on the material and application (forging conditions, etc.) of the hard film, may be insufficient to impart wear resistance to the mold in some cases. In contrast, when the thickness of the hard film is increased, the properties of the surface of the hard film greatly change from those of the surface of the base material, which is an underlayer. As will be described in connection with the production method later, the surface of the base material is adjusted depending on the desired properties of the surface of the mold to a certain degree, and then the surface is covered with the hard film. Accordingly, when the properties of the surface of the hard film greatly change with respect to those of the base material, the necessity to adjust the surface again arises. Adjusting the unevenness in a great amount of change lowers the production efficiency, and appropriately adjusting the properties of the surface of the mold becomes difficult since the amount of change is finite. Therefore, it is preferable that the thickness of the hard film is 12 μm or lower. In addition, as for the mold for use in warm and hot forging of aluminum materials, since the processed material is soft, abrasion of the mold (hard film) by forging is relatively low. Therefore, the hard film formed needs not be so thick, and the film thickness is more preferably 7 μm or lower, and even more preferably 5 μm or lower.

The hard film of the mold for plastic forming according to the present invention preferably comprises either a nitride, a carbonitride or a carbide containing Al and at least one of Ti and Cr. In hot-forging, a processed material, even an aluminum material having a relatively low melting point, often reaches 500° C. or higher. Furthermore, since hot-forging is performed in the atmosphere, a material having an oxidation start temperature of 500 to 600° C. or higher is preferably applied to the hard film. Nitrides, carbonitrides and carbides have excellent oxidation resistance and heat resistance since they have large negative values of free energy during formation generally in this order. Among them, nitrides and carbonitrides based on a nitride of Al (AlN) and having Ti and Cr added thereto, i.e., materials represented by the compositional formula $Al_{1-x-y}Ti_xCr_y(CzN_{1-z})_w$ ($x \geq 0$, $y \geq 0$, $0<x+y<1$, $0 \leq z<1$, $w>0$), have excellent oxidation resistance. In addition, adding Ti and Cr increases hardness. It should be noted that w in the compositional formula, that is, the ratio of the total number of C and N atoms to the total number of Al, Ti and Cr atoms is the value which varies depending on the number of atoms of each element (the values of x, y and z), which will be hereinafter omitted. Furthermore, the hard film is preferably a material having Si and Y added to the above-mentioned nitrides and the like. While Nb, Ta and other substances may be also added to the hard film, the ratio of the total number of the atoms of three elements: Al, Ti and Cr to the total number of atoms of metal elements such as Al and Si and metalloid elements is preferably 0.7 or higher. It is more preferable that the hard film comprising these materials has a thickness within the above-described range in order to provide sufficient resistance to warm and hot forging of aluminum materials.

<Method for Producing Mold for Plastic Forming>

The method for producing the mold for plastic forming according to the present invention comprises performing a base material roughening step for roughening the surface of a base material formed into the configuration of the mold, a base material polishing step for polishing the roughened surface, and a film formation step for forming a hard film on the surface of the base material. Moreover, in order to cause the properties of the surface of the mold, that is, the surface of the hard film to fall within the above-described range (Ra: 0.3 to 2 μm, Rsk: 0 or lower), the base material is adjusted to have the surface properties which fall within the predetermined range described below in both the base material roughening step and the base material polishing step. Each of the steps will be now described in detail.

(Base Material Roughening Step: 1 μm<Ra≤2 μm)

The base material roughening step roughens the surface of the base material by a roughening process using the shot blast method. The arithmetic averaged roughness Ra of the surface of the base material is lowered to a certain degree by the following base material polishing step. Therefore, in the base material roughening step, the surface is adjusted to attain Ra>1 μm. The device and blast material employed may be those which are generally used for surface treatment of a metallic material, and the air pressure for blasting the blast material is normally 5 to 10 kg/cm$^2$. Usable blast materials include particles formed of alumina (corundum) and SiC (alundum) and having a mean particle diameter of about 20 to 400 μm. Using a blast material having a large mean particle diameter allows roughening of the configuration of the surface in a short period of time. While this also increases Ra, it causes the skewness Rsk to be largely concave-biased (biased in the depth direction) (Rsk>>0). Therefore, the polishing time in the following base material polishing step needs to be extended. In the roughening process by the shot blast method, although there is a difference resulting from the grain size, blasting density and other conditions of the blast material, skewness Rsk of the roughened surface tends to be concave-biased (refer to Rsk>0, FIG. 1B). When the surface is roughened to the value of Ra higher than 2 μm, it becomes excessively concave-biased, that is, the value of Rsk is too high, which makes adjusting the value of Rsk to 0 or lower in the base material polishing step difficult. Therefore, the surface is adjusted to attain Ra≤2 μm.

(Base Material Polishing Step: 0.3 μm≤Ra≤2 μm, Rsk≤0)

In the base material polishing step, the surface of the base material roughened in the base material roughening step is ground to adjust the skewness Rsk to 0 or lower. More specifically, the top portions of the convexes in unevenness formed by roughening are removed by polishing relatively in a large amount, whereby the arithmetic averaged roughness Ra is lowered, and at the same time the size of the convexes (Rsk>0) which has been small relative to that of the concaves becomes similar to or larger than that of the concaves (Rsk≤0). Abrasives used for mirror finishing by polishing at such a minute polishing amount include diamond particles (abrasive grains) having a mean particle diameter of 4 to 8 μm. In addition, in order to grind the surface of the base material molded into the intricate configuration of the mold, the polishing device applied in the base material roughening step is preferably a blast-type device. However, since it is difficult to directly blast the above-mentioned minute abrasives, particles comprising an elastic resin and having a particle diameter of about 1 to 2 mm with diamond abrasive grains deposited on the surfaces thereof are used as a blast material. Examples of devices which use such a blast material include Aero Lap (registered trademark, Yamashita Works Co., Ltd.). Such a polishing process allows adjusting of the properties of the surface of the mold to those similar to the surface properties while leaving the unevenness formed in the base material roughening step to a certain degree.

(Film Formation Step)

The hard film can be formed by the CVD method and the PVD method, among which film formation by the PVD method which allows processing at a low temperature process is preferable, and in particular reactive sputtering and the ion plating method are recommended. According to these method, for example, when a film of a nitride of Al with Ti added ($(Al_{1-x}Ti_x)N$) is formed as a preferable hard film to provide a mold for hot-forging of aluminum materials, using a target comprising an alloy having the composition ($Al_{1-x}Ti_x$) and feeding nitrogen ($N_2$) into a processing chamber within a range for attaining a predetermined pressure allows formation of a hard film having the desired composition. When a carbonitride film is formed, a C-containing gas such as methane ($CH_4$) and like hydrocarbons may be fed along with $N_2$ at a partial pressure depending on the ratio of C to N in the carbonitride.

(Surface Finishing Step)

After the film formation step, a surface finishing step may be further performed to adjust the properties of the surface of the hard film. Depending on the thickness of the hard film, film formation conditions, and the properties of the surface of the base material which is an underlayer, the surface properties of the hard film may become more rough than those of the base material (arithmetic averaged roughness Ra is increased) in some cases. In addition, in film formation by arc ion plating (AIP), particles are scattered from a target to the base material, and therefore the surface of the hard film itself is roughened. To this end, the surface of the hard film is ground in a minute polishing amount to adjust the surface to have the desired properties. Polishing of the hard film can be performed by a method similar to that in the above-mentioned base material polishing step. By the method described above, the mold for plastic forming according to the present invention can be produced.

<Method for Forging Aluminum Material>

In the method for forging an aluminum material according to the present invention, an aluminum material is warm-forged or hot-forged by using the above-mentioned mold for plastic forming according to the present invention. At that time, the mold is used with a lubricant applied on the surface thereof. The lubricant and other forging conditions applied can be those already known in warm and hot forging of aluminum materials. A typical hot-forging method includes subjecting an ingot of an aluminum material (or aluminum alloy material) having desired components to a homogenizing heat treatment, leaving the ingot as it is or cooling the ingot, reheating the ingot to a start temperature within a predetermined range. Meanwhile, the mold attached to a forging press machine is heated to a predetermined temperature so that it can be forged by this forging press machine. The start forging temperature and end forging temperature of aluminum materials (ingots, forged materials) are set depending on their components. By using the mold for plastic forming according to the present invention, the lubricant applied on the surface of the mold is retained until the end of forging between the mold and the aluminum material to provide a forged aluminum article free of seizure.

Example 1

While the mode for carrying out the present invention has been described above, Examples in which the effects of the present invention have been confirmed will be specifically described below comparing with Comparative Examples which do not meet the requirements of the present invention. It should be noted that the present invention is not limited to these Examples.

(Base Material)

The base material used was SKD61 (HRC50) machine-processed into a disk configuration having a diameter of 220 mm and a thickness of 20 mm.

(Base Material Roughening Step)

The surface of the base material was shot-blasted at an air pressure of 10 kg/cm$^2$ to roughen the surface. Corundum particles were used as the blast material, which were, shown in Table 1, particles 20 (mean particle diameter 400 μm), 50 (mean particle diameter 300 μm), 80 (mean particle diameter 180 μm) and 300 (mean particle diameter 20 μm). The blasting times were adjusted respectively so that the values of arithmetic averaged roughness Ra of the surfaces of the base materials range from higher than 1 μm and 2 μm or lower. The values of arithmetic averaged roughness Ra and skewness Rsk of the roughened surfaces were measured by means of a surface roughness meter (manufactured by Taylor Hobson Ltd., Form Talysurf Intra), which are shown in Table 1. It should be noted that the base material of specimen No. 5 was not shot-blasted.

(Base Material Polishing Step)

The surfaces of the base materials of specimens No. 5 to 10 were blasted with resin particles with diamond abrasive grains having a mean particle diameter of 4 to 8 μm deposited on the surfaces thereof by a blast polishing device (Aero Lap YT-100, manufactured by Yamashita Works Co., Ltd.), and were ground to attain the skewness Rsk of the surfaces of 0 or lower and the arithmetic averaged roughness Ra not lower than 0.3 μm (except for specimen No. 5). The values of Ra and Rsk of the surfaces were measured in a similar manner to that performed after roughening, which are shown in Table 1.

(Film Formation Step)

On the surfaces of the base materials were formed hard films each comprising $(Al_{0.55}Ti_{0.2}Cr_{0.2}Si_{0.05})N$ and having a thickness of 4 μm by a film forming device having an arc ion plating (AIP) system. The base materials were introduced into a processing chamber of the device. The processing chamber was evacuated to $1\times10^{-3}$ Pa or lower. The base materials were heated to about 400° C., and were then subjected to sputter cleaning for 5 minutes by using Ar ions. Films were formed at 4 Pa by using Al alloy targets (diameter: 100 mm) with Ti, Cr or Si added depending on the hard film and an arc current of 150 A, applying a bias of −70 V to the base material, and feeding nitrogen ($N_2$) to the processing chamber.

(Surface Finishing Step)

By polishing the surface of the hard film in a manner similar to that of the base material, particles deposited on the surfaces were removed, giving mold specimens (No. 1 to 10). The values of Ra and Rsk of the surface of the hard film were measured, which are shown in Table 1.

(Ring Compression Test)

In order to evaluate the state of deposition of the lubricant onto the surfaces of the specimens, a ring compression test was conducted to measure the coefficients of friction μ of the specimens. The ring compression test is a test for determining the relationship between a coefficient of friction and a draft from the percentage change of the inner diameter of a ring-shaped processed material in a compression step which simulates a forging process. A 6000-series Al alloy material was machine-processed into a ring configuration having an outer diameter of 60 mm, an inner diameter of 30 mm and a height of 20 mm, giving a processed material. A graphite-based lubricant was applied onto the specimens, and two of these specimens were used as a set. A heated processed material was nipped between a set of the specimens, and was compressed at a processed material temperature of 500° C. and a specimen temperature of 400° C. and at a draft of 70%. The same specimens were subjected to ten cycles of the ring compression test while the lubricant was applied to the specimen at each cycle and the processed material was replaced with a new one at each cycle. The coefficients of friction μ obtained in the 5th to 10th cycles of the ring compression test were measured, and its average was calculated. The average values of the coefficients of friction μ are shown in Table 1. When the average value of the coefficients of friction μ is 0.4 or higher, it was considered that the surfaces of the specimens could not retain the lubricant in the ring compression test, and the surfaces came in direct contact with the processed material so that the coefficients of friction μ increased. The acceptable reference was set to be the average value of the coefficients of friction μ lower than 0.4.

TABLE 1

| Specimen | | Base material surface treatment | | | | | Hard film | | | | |
|---|---|---|---|---|---|---|---|---|---|---|---|
| | | Roughening | | | Polishing | | Hard film specification | | | | |
| Section | No. | Specification of blast material in shot blast | Ra(μm) | Rsk | Ra(μm) | Rsk | Composition (atomic ratio) | Film thickness (μm) | Surface properties Ra(μm) | Surface properties Rsk | Coefficient of friction μ |
| Comparative example | 1 | Mean particle diameter 400 μm | 2.0 | 0.8 | — | — | $(Al_{0.55}Ti_{0.2}Cr_{0.2}Si_{0.05})N$ | 4 | 2.0 | 0.8 | 0.55 |
| | 2 | Mean particle diameter 300 μm | 1.5 | 0.6 | — | — | | | 1.5 | 0.5 | 0.45 |
| | 3 | Mean particle diameter 180 μm | 1.1 | 0.4 | — | — | | | 1.1 | 0.2 | 0.42 |
| | 4 | Mean particle diameter 20 μm | 1.0 | 0.2 | — | — | | | 0.8 | 0.1 | 0.43 |
| | 5 | — | — | — | 0.1 | −0.2 | | | 0.1 | −0.2 | 0.40 |

TABLE 1-continued

| Specimen | | Base material surface treatment | | | | | Hard film | | | | |
|---|---|---|---|---|---|---|---|---|---|---|---|
| | | Roughening | | | Polishing | | Hard film specification | | | | |
| Section | No. | Specification of blast material in shot blast | Ra(μm) | Rsk | Ra(μm) | Rsk | Composition (atomic ratio) | Film thickness (μm) | Surface properties Ra(μm) | Surface properties Rsk | Coefficient of friction μ |
| Example | 6 | Mean particle diameter 400 μm | 2.0 | 0.8 | 1.5 | −0.1 | | | 1.5 | −0.1 | 0.37 |
| | 7 | Mean particle diameter 300 μm | 1.5 | 0.6 | 1.2 | −0.2 | | | 1.2 | −0.2 | 0.29 |
| | 8 | Mean particle diameter 180 μm | 1.1 | 0.4 | 0.5 | −0.6 | | | 0.5 | −0.6 | 0.20 |
| | 9 | Mean particle diameter 20 μm | 1.0 | 0.2 | 0.4 | −0.6 | | | 0.4 | −0.6 | 0.25 |
| | 10 | Mean particle diameter 180 μm | 1.1 | 0.4 | 0.4 | −0.5 | | | 0.8 | −0.6 | 0.17 |

As shown for specimens No. 1 to 4 in Table 1, the roughening process using the shot blast method only did not result in the skewness Rsk of the surfaces of the base materials of 0 or lower even though the blast material was changed, and resulted in the configuration of unevenness which was largely concave-biased, which affected the properties of the surfaces of the hard films. As a result, it is presumed that the lubricant deposited on the surfaces of the convexes were insufficient, which lowered wear resistance. In contrast, specimens No. 6 to 10 subjected to the polishing process after the roughening process had the values of arithmetic averaged roughness Ra remaining within the range of the present invention while they had the values of Rsk of 0 or lower. Therefore, the state that the lubricant was deposited was retained in the ring compression test, and wear resistance was obtained. Meanwhile, it is presumed that they had small capacities of concaves since specimens No. 5 subjected only to the polishing process were in the state of mirror finish with insufficient values of Ra and values of Rsk less than 0, and that their wear resistance was lowered since sufficient lubricant was not retained on their surfaces.

Comparing specimens No. 1 to 4, the tendency that larger the mean particle diameter of the blast material, the higher the value of Ra (rougher) and the positively higher the value of Rsk (concave-biased) was observed. As opposed to these specimens, specimens No. 6 to 9 each of which was subjected to the polishing process under the same conditions generally had the values of Ra lowered to similar degrees, and their values of Rsk were lowered to be negative. To this end, specimen No. 10 was prepared from specimen No. 3, which had a relatively low value of Rsk after the roughening process, with a shorter polishing process time on the base material than for specimen No. 8. As a result, a reduction in its value of Ra was suppressed, and yet its value of Rsk was sufficiently lowered. Accordingly, specimen No. 10 achieved excellent surface properties which provide good state of deposition of the lubricant, and especially high wear resistance.

Example 2

Variations of specimen No. 10, which was the best (having the lowest coefficient of friction μ) in Example 1, were prepared for comparison by using a base material subjected to the surface treatment under the same conditions and varied compositions and film thicknesses of the hard film.

A base material having the same material and configuration as that in Example 1 was subjected to the base material roughening step and base material polishing step under the same conditions as those for specimen No. 10. On this base material were formed hard films having the compositions shown in Table 2 by using a metal target or an alloy target depending on their compositions by an AIP device as in Example 1. Carbonitrides were formed by feeding methane ($CH_4$) at the partial pressures depending on the compositions of the hard films along with $N_2$ at a pressure of 4 Pa, while carbides were formed by feeding $CH_4$ at a pressure of 1.3 Pa. In addition, film formation times were varied to attain the film thicknesses shown in Table 2. In specimen No. 23, diamond-like carbon (DLC) was formed by an unbalanced magnetron sputtering (UBMS) device using a C target, feeding 10% by volume of $CH_4$ in an Ar atmosphere, and discharging at a pressure of 0.6 Pa. The surfaces of the formed hard films were ground in a manner similar to that in Example 1, giving mold specimens (Nos. 11 to 23). The values of Ra and Rsk of the surfaces of the hard films were measured in a manner similar to that in Example 1, which are shown in Table 2. As Comparative Examples, specimen No. 24, which comprises only the base material and no hard film formed thereon (film formation step and surface finishing step were not performed), was also prepared.

As in Example 1, the coefficients of friction μ were determined in the ring compression test, which are shown in Table 2. The results of specimen No. 10 are also shown in Table 2.

TABLE 2

| Specimen | Hard film | | | | | |
|---|---|---|---|---|---|---|
| | Hard film specification | | | | Ring compression test | |
| No. | Composition | Film thickness (μm) | Surface specification Ra(μm) | Surface specification Rsk | Coefficient of friction μ | Remarks |
| 10 | $(Al_{0.55}Ti_{0.2}Cr_{0.2}Si_{0.05})N$ | 4 | 0.8 | −0.6 | 0.17 | |
| 11 | $(Al_{0.55}Ti_{0.2}Cr_{0.2}Si_{0.05})N$ | 0.5 | 0.4 | −0.7 | 0.26 | Part of base material exposed |

TABLE 2-continued

| Specimen No. | Hard film: Hard film specification: Composition | Film thickness (μm) | Surface specification: Ra(μm) | Surface specification: Rsk | Ring compression test: Coefficient of friction μ | Remarks |
|---|---|---|---|---|---|---|
| 12 | $(Al_{0.55}Ti_{0.2}Cr_{0.2}Si_{0.05})N$ | 2 | 0.6 | −0.6 | 0.18 | |
| 13 | $(Al_{0.55}Ti_{0.2}Cr_{0.2}Si_{0.05})N$ | 7 | 0.8 | −0.6 | 0.17 | |
| 14 | $(Al_{0.55}Ti_{0.2}Cr_{0.2}Si_{0.05})N$ | 10 | 1.0 | −0.1 | 0.29 | |
| 15 | $(Al_{0.55}Ti_{0.2}Cr_{0.2}Si_{0.05})N$ | 15 | 1.2 | −0.2 | 0.38 | |
| 16 | $(Al_{0.5}Ti_{0.5})N$ | 4 | 0.6 | −0.5 | 0.25 | |
| 17 | $(Al_{0.6}Cr_{0.4})N$ | 4 | 0.5 | −0.5 | 0.23 | |
| 18 | $(Al_{0.5}Ti_{0.5})C_{0.5}N_{0.5}$ | 4 | 0.6 | −0.5 | 0.27 | |
| 19 | TiN | 4 | 0.5 | −0.4 | 0.30 | Film surface abraded |
| 20 | $(Ti_{0.5}Cr_{0.5})C_{0.5}N_{0.5}$ | 4 | 0.6 | −0.6 | 0.28 | Film surface abraded |
| 21 | $Ti\ (C_{0.5}N_{0.5})$ | 4 | 0.6 | −0.6 | 0.32 | Film surface abraded |
| 22 | TiC | 4 | 0.6 | −0.6 | 0.25 | Film surface abraded |
| 23 | DLC | 4 | 0.4 | −0.5 | 0.35 | Film surface abraded |
| 24 | — | 0 | 0.4 | −0.5 | 0.45 | Comparative example |

(Evaluation by the Thickness of the Hard Film)

By providing the surface of the base material with good properties, the properties of the surfaces of all of specimens No 11 to 24 were within the range of the present invention. However, the specimen No. 24 did not form the hard film. Therefore, although its surface properties were within the range of the present invention, its surface was oxidized due to the heat generated by sliding during the ring compression test since its base material does not have sufficient oxidation resistance, resulting in abrasion and deformation of the surface. This caused seizure on the processed material to increase its coefficient of friction. Although specimen No. 11 had sufficiently lowered coefficient of friction, the thickness of the hard film thereof was insufficient as a mold for hot-forging of an Al alloy material, and the hard film was abraded by the ten cycles of the ring compression test, and a portion of the base material was exposed on the surface thereof. In contrast, specimens No. 10, 12 and 13 had the thicknesses of the hard films within an especially preferred range, and therefore the properties of the surfaces of the hard films were within the range of the present invention. In addition, the specimens maintained good wear resistance even after the ten cycles of the ring compression test. On the other hand, thick hard films were formed in specimens Nos. 14 and 15, and their surface properties were greatly changed with respect to the base material. Accordingly, their values of Rsk were increased (approached 0) although they are within the range of the present invention. It is therefore presumed that their retention of the lubricant was worse than in specimens Nos. 10, 12 and 13, resulting in lowered wear resistance.

(Evaluation by Composition of the Hard Film)

In specimens Nos. 16 to 18, as specimen No. 10, the hard film was formed from Al nitride or Al carbonitride with Ti and Cr added thereto, and therefore good wear resistance as a mold for hot-forging of the Al alloy material was obtained. In contrast, in specimens Nos. 19 to 23, the hardness of the hard films was insufficient as a mold for hot-forging of the Al alloy material. Accordingly, in these specimens, the hard films were abraded by the ten cycles of the ring compression test, and abrasion was visually confirmed on the surfaces of the hard films after the 10th cycle. Furthermore, increases in the coefficients of friction which are presumably due to abrasion were observed depending on the compositions of the hard films.

What is claimed is:

1. A mold for plastic forming having a hard film formed on a base material comprising a metal, and the surface of the hard film having an arithmetic averaged roughness Ra of 0.3 μm or higher but 2 μm or lower, and a skewness Rsk of 0 or lower.

2. The mold for plastic forming according to claim 1, wherein the thickness of the hard film is 1 μm or higher but 12 μm or lower.

3. The mold for plastic forming according to claim 1 or 2, wherein the hard film is either a nitride, a carbonitride or a carbide containing Al and at least one of Ti and Cr.

4. The mold for plastic forming according to claim 3 which is for use in warm-forging or hot-forging of an aluminum material.

5. A method for producing a mold for plastic forming in which the surface of the hard film having an arithmetic averaged roughness Ra: 0.3 μm or higher but 2 μm or lower and skewness Rsk: 0 or lower, the method comprising:

a base material roughening step for adjusting the surface of a base material comprising a metal to attain an arithmetic averaged roughness Ra: higher than 1 μm but 2 μm or lower by using a shot blast method;

a base material polishing step for adjusting the surface of the base material by polishing to attain an arithmetic averaged roughness Ra: 0.3 μm or higher but 2 μm or lower and skewness Rsk: 0 or lower; and a film formation step for forming a hard film on the surface of the base material.

6. A method for forging an aluminum material comprising warm-forging or hot-forging of an aluminum material by using the mold for plastic forming according to claim 3 with a lubricant applied on the surface thereof.

* * * * *